United States Patent [19]

Gardner

[11] 4,447,964

[45] May 15, 1984

[54] DRYER DRAINAGE BY RECIRCULATION WITH PRIMARY AND SECONDARY DRYERS

[76] Inventor: Thomas A. Gardner, 513 Clark St., Neenah, Wis. 54956

[21] Appl. No.: 324,190

[22] Filed: Nov. 23, 1981

[51] Int. Cl.[3] ..... F26B 13/08

[52] U.S. Cl. ..... 34/16; 34/41; 34/48; 34/54; 34/119

[58] Field of Search ..... 34/48, 54, 119, 124, 34/16, 41; 162/290, 207, 253

[56] References Cited

U.S. PATENT DOCUMENTS

| | | | |
|---|---|---|---|
| 2,696,679 | 12/1954 | Cram | 34/119 |
| 2,811,787 | 11/1957 | Clements | 34/119 |
| 2,885,790 | 5/1959 | Cram | 34/48 |
| 2,952,297 | 9/1960 | Hollis | 34/119 |
| 2,992,493 | 7/1961 | Fishwick | 34/48 |
| 4,222,178 | 9/1980 | Moran | 34/119 |
| 4,253,245 | 3/1981 | Perrault | 34/119 |

OTHER PUBLICATIONS

"Design Considerations Affecting Paper Machine Drier Drainage Systems" H. P. Fishwick, Jun. 1957.

Fan Engineering–Published by Buffalo Forge Company, pp. 69–71.

U.S. Abandoned Application Ser. No. 426861, filed 12/20/73.

*Primary Examiner*—Larry I. Schwartz

*Attorney, Agent, or Firm*—Henry C. Fuller, Jr.

[57] ABSTRACT

A steam dryer system for drying a moving web and including a primary series of rotatable drying drums, steam inlet conduits coupled to said rotatable drying drums for introducing steam thereinto, outlet conduits coupled to said rotatable drying drums for exhausting blow-through steam with noncondensible gases and condensate therefrom, recirculation means including a steam jet compressor to recirculate blow-through steam from said outlet conduits back to said inlet conduits, recirculation control means comprising instruments to measure velocity pressure of the recirculation flow and to control the action of said jet compressor, a further number of secondary drying drums having inlet conduits and a pressure control valve connected to the outlet of said jet compressor and with outlet conduits connected to a condenser, and pressure control means comprising instruments to measure and control the input pressure in said secondary drying drums.

9 Claims, 8 Drawing Figures

DRYER DRAINAGE BY RECIRCULATION WITH PRIMARY AND SECONDARY DRYERS

TECHNICAL FIELD

The present invention relates to a recirculating steam dryer system for drying a moving web, and particularly to the manner in which the flow of steam and its by-products is routed and regulated to dry the web and exhaust noncondensible gases from the system without wasting steam.

BACKGROUND ART

In the drying of paper and other materials in web form, cylindrical dryer rolls heated internally with steam are in common use. Steam is admitted to the interior of the rolls through roll journals equipped with rotary steam joints, and a mixture of steam, noncondensible gases, and condensate is drained from the interior by means of syphon pipes that pass through the journals. Control of drainage from the rolls is a difficult problem that frequently results in loss of drying capacity, loss of drying control, non-uniform drying, waste of steam, waste of cooling water for condensing waste steam, high maintenance cost, and high capital cost for equipment. The object of this invention is an improved method for controlling flow of drainage such that most of the problems are avoided.

FIG. 1 shows a typical arrangement for supplying steam and draining condensate and blow-through steam from a dryer roll. Although that arrangement of steam supply and syphon equipment is most typical, there are some variations. On very wide paper machines, the steam may enter through a rotary joint on one journal, and the syphon pipe may drain the dryer through a second rotary joint on the other journal. Another variation employs a stationary syphon pipe in which the syphon is held stationary as the roll rotates. The object of stationary syphons is to avoid the effects of centrifugal force on the fluid in the radial portion of the syphon. The problem with stationary syphons is that they cannot be mounted very close to the dryer shell without risking frequent breakage, and the rim of condensate therefore tends to be thicker in normal operation. Because of this problem, stationary syphons are much in the minority as applied to paper machines.

Condensate is formed within paper machine dryer rolls as steam is condensed on their interior surfaces, particularly when paper is being dried. At the high web speeds (1000 to 3600 feet per minute) in current practice, the condensate is pressed by centrifugal force against the inside surface of the roll shell to form a liquid rim within the dryer drum. At a web speed of 2500 feet per minute, for example, the centrifugal force acting on the condensate in a five foot diameter roll is over ten times the force of gravity. The liquid rim is not stagnant but oscillates with respect to the surface under the influence of gravity force as the roll rotates. In spite of this motion, the liquid rim interferes with heat transfer from the steam to the drying paper, and it has further been linked to non-uniform heat transfer in respect to edges of the drying web as compared to center.

When drainage of the liquid condensate, along with some steam, fails to occur on a continuous basis, the thickness of the liquid rim builds up to a point where the water cascades and ultimately collapses into a deep, agitated pond in the rotating roll. Thus when drainage fails the dryer becomes less and less effective until it contributes little to drying. Not only is drying capacity lost, but the heavy load of water causes breakage of syphons, severe loads on roll bearings, and high and unstable loads on the roll driving equipment. A primary requirement of the drainage method is therefore to maintain the thickness of the liquid rim as small as possible by adequately draining the dryer drums.

Air and other noncondensible gases also cause problems. All commercially generated steam contains a small fraction of such gases that must be purged continuously from any vessel in which the steam is condensed. If such gases are allowed to accumulate, they reduce the partial pressure and temperature of the steam. They further tend to concentrate locally near the surface of condensation and seriously impede heat transfer. When such gases are present they are not necessarily uniformly distributed in the steam space in a vessel and may cause great differences in heat transfer from one point to another on the condensing surface.

In the present state of the art the need to maintain the thinnest possible rim of condensate and to continuously purge noncondensible gases is recognized. Accordingly, dryer syphons are mounted as close as possible to the inside shell surface of the dryer roll, and a substantial amount of steam blows out of the roll through the syphon, entraining the condensate as well as purging out noncondensible gases. The condensation of part of the steam entering a dryer roll results in an increase in the concentration of noncondensible gases. Consequently, the blow-through steam contains a higher fraction of noncondensibles, but the fraction is usually very small because the incoming fraction is so small.

After the noncondensible gases have been purged out of the roll, they remain as a minor contaminant in otherwise valuable steam. The blow-through steam and noncondensible gases from all of the dryer rolls in a paper machine cannot be simply thrown away without great waste of heat energy. The efficient utilization of this contaminated blow-through steam is a primary objective of all steam control and dryer drainage systems.

When drainage occurs on a continuous basis from a dryer with rotating syphon, the pressure differential between dryer inputs and outputs necessary to drain the dryer depends on a composite of four primary pressure drop factors. These factors are:

1. friction and dynamic losses of essentially dry steam flowing from the steam inlet manifold to the interior of the dryer;
2. friction and dynamic losses of the two phase (liquid-gas) mixture flowing through the syphon to the drain manifold;
3. pressure loss in consequence of centrifugal force acting on the liquid portion of the fluid in the radial part of the rotating syphon pipe; and
4. pressure recovery in consequence of gravity force acting on the liquid portion of the fluid in the external piping draining downward from the dryer to the drain manifold.

Because each of the four differential pressure factors varies in a different manner as conditions change, the net differential pressure required to maintain drainage tends to be a complex function and varies substantially with conditions of operation. For example, machine speed primarily affects centrifugal force in the syphon and has little effect on friction losses. Steam pressure strongly affects friction losses and centrifugal force, and it also governs the rate of condensing. Under normal drying load, the rate at which paper is dried and the associated rate of condensing inside the dryer depend on the condensing temperature of the steam which is a function of steam pressure, i.e., an increase in steam pressure normally increases drying rate.

In order to demonstrate differential pressure effects, I have prepared FIG. 5, showing typical differential performance curves for a dryer in a large high speed paper machine. The dryer is equipped with a rotary syphon and is operating under normal drying load. The ordinate of the graph is the difference in pressure betweeen steam supply and drainage manifolds, which is called differential pressure. The abscissa is the amount of blow-through steam (steam that accompanies the condensate out through the syphon pipe) expressed as a percentage of condensing rate. There are two sets of three curves for three steam pressures, one set for a web speed of 3500 feet per minute (fpm) and one for 2500 fpm. The condensing rate is approximately constant at any given steam pressure, whatever the machine speed, and is highest at the highest pressure.

The curves of FIG. 5 are an extension of published research in which the nature of friction losses and centrifugal pressure losses with two phase flow in rotating syphons was described. I have extended this work to include inlet steam friction losses, external friction losses in two phase flow, and pressure recovery due to drop in level of two phase flow. More important, my curves fairly accurately predict the actual differential pressures that would occur at each steam pressure because I have also developed a method to accurately predict the actual condensing rate in the subject dryer, whatever its location in the drying process. Of special importance to the invention is the fact that the condensing rate is approximately proportional to the square root of the density of the steam in the dryer. The density of steam of course increases with pressure.

The curves of FIG. 5 clearly demonstrate the effects of centrifugal force. The difference between high speed and low speed sets of curves is primarily centrifugal force effect. The upward hook at the left ends of the curves is also a centrifugal force effect. At small levels of blow-through steam the radial portion of the rotating syphon pipe contains a greater proportion of liquid water in the liquid-gas mixture. Since only the water fraction of the mixture has significant mass, an increase in this fraction results in greater centrifugal force.

When stationary syphons are in use, the centrifugal force factor is not part of the differential pressure, and dryer speed does not affect the differential performance curves. If the curves for stationary syphons were to be plotted on FIG. 5, they would fall only slightly below the curves for 2500 fpm at high blow-through rates and would all approach roughly 1 pound per square inch (psi) at 2½% blow-through, at which point they would nearly converge.

If dryer drainage stops for some time, it is necessary to use very high differential pressure to overcome centrifugal force acting on water alone in rotary syphons. The differential pressure needed to overcome the centrifugal force of water alone is about 10 psi at 2500 fpm and about 20 psi at 3500 fpm. Since it is often difficult to secure such high differential pressures on an operating machine, it is extremely important that drainage be maintained continuous on all dryers in a high speed machine.

In prior art practice with a group of dryers connected to inlet and outlet manifolds, the machine operator selects a differential pressure that he believes workable and sets the appropriate differential control instrument to maintain the selected differential pressure. Once set, the instrument is seldom reset unless some fairly obvious trouble develops. For example, with reference to FIG. 5, the differential setting could be as low as 6 psi for normal operation at 20 psi steam pressure and 2500 fpm machine speed. Upon increasing production by raising steam pressure to 50 psi and machine speed to 3500 fpm the dryers would stop draining and fill with water because 6 psi differential is not adequate for drainage at the new condition. The operator would in this case set the differential pressure between 8 psi and 12 psi by trial and error methods. Thus, with the prior art differential control the operator is blind as to whether or not the dryers are draining and is forced in most cases to set the differential pressure control much higher than necessary to make sure the dryers do drain. There is no way for him to measure or judge when differential pressure is excessive or insufficient. Even when some dryers stop draining, the operator may have no more than an indication that paper drying has been reduced but be unable to pinpoint which dryers or which section of dryers is at fault. This is a common occurrence on paper machines.

For operation according to the conditions shown in FIG. 5, the semipermanent differential pressure setting would ordinarily be about 9 psi and the blow-through rate would be about 27% at the highest pressure and speed. With conventional differential control, the 9 psi pressure would be maintained at all times, even when operating at 20 psi at 2500 fpm, to avoid the problems which occasionally result when a lower differential pressure is used. In this case the blow-through rate would be about 34%, which is unnecessary and expensive. Not uncommonly, system specifications require operation at an input pressure of 0 psi (gauge pressure), in which case the blow-through rises to 39% at 2500 fpm.

In order to operate with adequate drainage at 0 psi steam pressure, a group of dryers must discharge a mixture of steam and condensate to a drainage manifold maintained at a substantial negative pressure or vacuum (9 psi vacuum in the above example) to maintain the differential pressure required to drain the dryers. Ordinarily such low drainage pressures could only be obtained by discharging the drain manifold directly to a vacuum system. A vacuum system usually consists of a condenser, vacuum pump, and condensate collection tank with condensate pump. The first few dryers in a paper machine are normally operated at an input steam pressure of 0 psi or less, and their blow-through steam and condensate are discharged directly to a vacuum system.

In the case of a main group of dryers, it is impractical to discharge all of the blow-through steam to a vacuum system because the resulting large waste of steam cannot be tolerated. On the other hand recompression and recirculation of the blow-through steam from the vacuum has been impractical because the specific volume of the blow-through steam under vacuum is so large that an extremely large thermocompressor, consuming an overwhelming amount of motive steam, was required to recompress it. Furthermore, an oversized thermocompressor is incompatible with dryer drainage requirements at higher steam pressures. It is also difficult to perceive how steam pressures could be maintained so low without some direct connection to a vacuum system.

Also of importance is the fact that two phase flow in dryer piping is highly erosive. In the above cases the reduced pressures and increased blow-through result in very large increases in the velocity of two phase flow through syphons and external piping. Erosion of dryer drainage piping is a common problem in practice.

What happens to dryer drainage upon loss in drying load, as during web breaks on paper machines, is also important. I have prepared the graph, FIG. 6, to illustrate the effect of load loss on differential performance. In this graph, I have used the gravimetric flow rate rather than percentage of blow-through steam as the abscissa. The upper curve corresponds to normal condensing load at the indicated conditions and is identical to the corresponding curve in FIG. 5 except for the scale of the abscissa. The lower curve is based on the same conditions, except the condensing rate is reduced to 12 percent of the normal rate.

With the prior art differential control the amount of blow-through steam increases as the condensing rate falls. In the case of a web break, if differential pressure were maintained at 8 psi, the blow-through rate would increase from about 580 pounds per hour (lb./hr.) under normal load to about 960 lb./hr. when condensing rate falls to 12% of normal. This large excess of blow-through steam during web break conditions is extremely difficult to handle. The usual result is that the major part is dumped into the condenser, and with most of the controlled groups of dryers dumping into the condenser the condenser becomes pressurized and control is lost. The resulting overpressurizing of some dryers and loss of drainage in others complicates rethreading the wet paper web on the dryers and re-establishing control of steam pressure and dryer drainage.

A common way to avoid this problem is to greatly increase the size of the condenser and its cooling water system. This does solve the control problem. Moreover, condensers and cooling water systems are expensive, and much steam is wasted in prior art systems during web break conditions.

In most paper machines, groups of dryer rolls are connected to piping manifolds to simplify control. For example, a paper machine with 40 dryers might be divided into four groups of varying numbers of dryers, each group being controlled as a unit. All of the dryer rolls in a given group are connected to a common steam supply manifold and to a common dryer drainage manifold mounted below the elevation of the dryers.

FIGS. 2 and 3 illustrate two typical steam routing and pressure control systems of the prior art for one group of eight dryers. Most paper machines have several such groups in which the number of dryers may range from two to about thirty. The two typical systems differ primarily in that the cascade type system of FIG. 2 is dependent on further sections of dryers at lower steam pressure to consume blow-through steam. The thermocompressor system of FIG. 3, on the other hand, is independent of the other sections but requires a continuous bleed of steam to a condenser to provide continuous discharge of noncondensible gases. Although pneumatic controls are shown in FIGS. 2 and 3, controls with equivalent electronic signals are also in use and the references to pneumatic controls herein apply equally well to electronic controls.

In FIG. 2 steam is supplied from steam supply line 30 through control valve 31 to inlet manifold 32 that supplies steam to the dryer rolls 20. The dryer rolls 20 drain through their syphons to manifold 33, and the mixture of blow-through steam and liquid condensate flows to the separator tank 34. The condensate is separated from the blow-through steam and returned to the boiler by means of pump 35 through control valve 36. The nearly dry blow-through steam leaves the top of the separator and flows through control valve means 37 and a check valve 29 to the next section of dryers. Should the next group of dryers be unable to absorb all of the blow-through steam, part of the flow will pass through control valve means 38 to a condenser type heat exchanger maintained at low pressure or vacuum. This latter portion of the steam is condensed to recover the condensate and to return it to the boiler. All of the latent heat of this latter steam is lost, and a substantial further cost is involved in providing cooling water to effect the condensation. It is therefore important to avoid costly loss of steam through valve 38 to the condenser.

In FIG. 2 the pressure transmitter 39 measures the steam pressure in manifold 32 and transmits a proportional pneumatic pressure signal to pressure control instrument 40. The controller 40 compares this signal to its set point pressure and transmits a pneumatic pressure signal to control valve 31 to decrease or increase steam pressure as required. The standard pneumatic signal has a pressure range of 3 to 15 psi. In the case of an air-to-open valve like valve 31 in FIG. 2, the valve begins to open at 3 psi and is wide open at 15 psi. The control signal continues to increase from 3 psi until the valve is sufficiently open to maintain the steam pressure set in the controller.

Differential pressure transmitter 41 measures the difference in pressure between inlet and outlet manifolds 32, 33 and transmits a signal that is a measure of the differential pressure to controller 42 which in turn transmits appropriate signals to the control valves 37 and 38. These valves are "split ranged" so that valve 37 starts to open at 3 psi and is wide open at 9 psi air signal. Valve 38 starts to open at 9 psi and is wide open at 15 psi. Usually the steam system is designed so that in normal operation an air signal of less than 9 psi is ample for control because valve 37 will pass all of the blow-through steam necessary to maintain differential pressure and none will be wasted through valve 38. A drawback to this cascade system is that the next section of dryers must be maintained at significantly lower steam pressure and must be able to absorb all of the blow-through steam if waste is to be avoided.

Another problem with the cascade method of dryer drainage shown in FIG. 2 is that the differential pressures required between sections are cumulative, so that the first section must always be operated at rather high pressure. Typically, dryers running at 2500 fpm surface speed require 6 to 8 psi differential pressure between inlet and outlet manifolds and a further 2 to 3 psi differential from outlet manifold through the separator and piping to the inlet of the next group of dryers. Thus in spite of the fact that the third group may discharge into a substantial vacuum (7 to 10 psi vacuum is common), the minimum workable steam pressure in the first section may be greater than 20 psi. This is much too high for good operating control of most paper machine dryers, and the problem becomes much worse with the higher speeds that are now common. Accordingly, the plain cascade system as above described is rapidly becoming obsolete except for older and slower machines.

The thermocompressor system of FIG. 3 is similar to FIG. 2 except that the blow-through steam is recirculated rather than being passed to another group of dryers. In order to do this the lower pressure blow-through steam must be recompressed to the inlet manifold pressure. This is commonly done by a steam jet compressor 43 that uses the potential energy of high pressure steam to do the work of compression. Both recompressed blow-through steam and spent motive steam are discharged into the inlet manifold. The amount of motive steam required and the size of the thermocompressor required depend on the amount of compression work to be done. Compression work increases with greater differential pressure, with greater recirculation flow, and with lower pressure steam because the specific volume of the steam to be compressed is larger. A significant amount of steam must be bled out to the condenser through bleed valve 45 in order to prevent the accumulation of noncondensible gases in this otherwise closed system.

In FIG. 3, pressure controller 40 normally controls valve 31, which opens over a signal range of 9 to 15 psi, with an air signal greater than 9 psi to maintain steam pressure in the inlet manifold. Differential controller 42 normally controls the motive steam flow in thermocompressor 43, which opens over a signal range of 3 to 9 psi, with an air signal less than 9 psi to maintain differential pressure as required by the control set point. The output signal of both controllers enters a signal selector relay 44 which selects the lower signal and transmits it to the thermocompressor 43. Thus if drying steam demand drops, as when no paper is being dried, the air signal from pressure controller 40 drops, initially closing valve 31 and eventually dropping low enough to take over control of the thermocompressor 43 and limit the supply of motive steam to the dryers as well. Meantime the reduced flow of motive steam reduces differential pressure, causing the air signal from differential controller 42 to increase until valve 38 opens to waste steam to the condenser. In this way both pressure and differential pressure control are maintained at all times. Although the thermocompressor system isolates each group of dryers, which simplifies the operation and control of paper machines, it consumes high pressure steam from line 28 that would otherwise be used for power generation. In practice this is quite wasteful as well, steam being wasted to the condenser when differential pressures are set high or when inlet pressure is low under which conditions the thermocompressor is frequently not large enough to do all of the recompression work. Even more important the waste of steam through bleed valve 45 becomes quite excessive in practice.

Although a continuous bleed of roughly 5 percent of the steam supplied is sufficient to purge noncondensibles, the working bleed rate is commonly in excess of 10 percent. A thermocompressor system is usually intended to operate over a wide range of controlled steam pressures, and it is essential that the bleed rate be adequate at the lowest pressure. The adjustable bleed valve is accordingly set manually for what is estimated to be adequate for low pressure operation. In practice this initial setting tends to be substantially more than 5 percent of the input steam to make sure that noncondensible gases will be purged. However, normal operation is usually at medium to high steam pressures and the loss of steam through the bleed valve becomes several times greater than that necessary at lowest pressure. The result is an unnecessarily waste of steam and high energy cost for drying paper.

The turndown control ratio of the thermocompressor system of FIG. 3 is also restricted on high speed machines. The greater dryer pressure differential required for high speed operation creates a need for more compression work to return the recycled steam to working pressure. At low steam pressures, the necessary compression work is more than even a large thermocompressor can do efficiently because the amount of high pressure motive steam required for compression becomes greater than the amount of steam that can be condensed in the dryers. Not uncommonly, the lowest controllable steam input pressure for a group of dryers having a recycle thermocompressor is 15 psi or higher. Also, thermocompressors are very expensive and there is a strong tendency to undersize them in practice.

The conventional differential pressure control method illustrated in FIGS. 2 and 3 is unreliable and wasteful because it does not respond correctly to the requirements of dryer drainage. Even at normal load conditions of operation, it causes excessive rates of blow-through steam at excessive differential pressures. These normal excesses result in larger thermocompressors consuming unnecessarily large amounts of high pressure motive steam. At other than normal operating conditions, as during paper breaks (no drying load) or during abnormally low steam pressure for drying at low rates, large amounts of steam are wasted to the condenser and frequently control is lost. Flooded dryers and breakage or harm to syphons are common in the industry.

An improvement over the conventional differential control was proposed and patented by U.S. Pat. No. 2,992,493, issued to Fishwick on July 18, 1961. Fishwick proposed to control dryer drainage in cascade type systems by controlling the flow rate of blow-through steam rather than the differential pressure between the steam intake and exhaust of individual dryers.

The numerous advantages anticipated by Fishwick never materialized. Fishwick expected that the amount of blow-through steam and the corresponding differential pressures would be reduced, and the result would be improved design of dryer drainage systems, steam savings, and lower operating pressures. However, Fishwick's control method in itself did not reduce the amount of blow-through steam or differential pressure needed by any group of dryers under specific operating conditions. Consequently, most of the problems of the cascade system, particularly the lack of control range, remain unabated.

The principle of blow-through control taught by Fishwick has been applied only to thermocompressor systems in Yankee dryers, in which a single dryer replaces the group of dryers shown here and the gravimetric rate of flow of blow-through steam from the separator 34 is measured by a flow meter and controlled by controller 42. Yankee dryers are normally operated with high steam pressures and with high rates of bleed steam, and in consequence derive little benefit from blow-through control.

SUMMARY OF THE INVENTION

The present invention seeks a practical means to overcome the major defects of dryer drainage controls for conventional dryer sections by extending the operable range of steam pressure control to include much lower steam pressures without the usual large waste of steam. My system utilizes readily available components and costs little more than the flawed systems it replaces.

In the present invention, the blow-through steam and its noncondensible gases are separated from entrained condensate and recompressed. A first part of the compressor output is returned to the inlet manifold of the primary group of dryers. A second part of the compressor output is bled away to supply one or more secondary dryers before being discharged to a vacuum system.

As a major aspect of my invention the velocity pressure of the blow-through steam before entering the thermocompressor is measured and maintained at a constant value. There are several well known commercial methods for measuring velocity pressure, any of which can be adapted for controlling it. I have used an orifice plate to augment the velocity pressure and make it easier to measure.

One important advantage of my system is that a system operator knows when dryer drainage is occurring and at what rate it is occurring, because the velocity pressure of blow-through steam passing through the orifice plate is a measure of the rate at which dryers are being drained.

A second major advantage of my system is that when a fixed velocity pressure of blow-through steam is maintained the rate of flow of blow-through steam is virturally a fixed proportion of the condensing rate of the dryers. In other words, the percentage of blow-through steam to condensing rate is nearly constant under normal drying load no matter what steam pressure or speed is used. For example, if steam pressure in dryers under normal drying load is increased from 0 psi to 50 psi, the density of the steam becomes four times greater and both blow-through rate and condensing rate are approximately doubled, the percentage of one to the other remaining nearly constant.

A third advantage of my invention is that the operable range of input steam pressure has been extended from the prior minimum value of about 15 psi all the way down to 0 psi, and most of the bleed steam is reused for drying paper, all the while maintaining efficient drainage of all dryers.

Still another advantage of my invention is that the thermocompressor alone can produce a sufficient pressure differential to allow adequate dryer drainage at low steam input pressures to the dryers. Furthermore, the thermocompressor need not be oversized or greatly enlarged for low pressure operation because of relationships I have discovered that permit me to automatically control and utilize much less blow-through steam at low pressures. These relationships are described in detail farther on.

In accordance with the requirements of my system, dryer drainage is not maintained by control of either differential pressure or gravimetric rate of flow of blow-through steam. What I control is the velocity pressure of the blow-through steam. The important difference between my method and methods utilizing the gravimetric rate of flow is that my, flow rate varies with the density of the steam, which is a function of the pressure. In consequence I do not maintain a constant gravimetric rate of flow but automatically vary the rate of flow as a function of steam pressure, as will be shown. The result is that at very low pressures I automatically obtain much reduced rates of flow. Yet the flow is sufficient to maintain undiminished drainage efficiency.

Inasmuch as the absolute value of velocity pressure per se is not directly related to dryer drainage, I find it desirable to measure the differential pressure as well. The measurement of differential pressure is made with the usual differential pressure transmitter and the measurement signal goes to the differential indicator located near the control instrument that controls the velocity pressure. Differential pressure can thus be used to set the velocity pressure controller. In operation the velocity pressure controller is set to obtain a prescribed differential pressure at a given drying condition, and the control setting of velocity pressure is thence retained for all subsequent conditions of operation. At all other conditions of operation the differential pressure differs from the amount prescribed for calibration. Periodically the control setting may be reviewed and reset by operating personnel.

In my preferred arrangement the secondary dryers have separate pressure controls. Secondary dryers must discharge to a vacuum system in order to be operable at low pressures and to get rid of the concentrated noncondensible gases in their blow-through steam. It is possible to serve the purpose of my invention by connecting secondary dryers directly to the thermocompressor discharge or even to the manifold 32 supplied by the thermocompressor. The secondary dryers would then be maintained at the same pressure as the main group. However, at high operating pressures, high differential pressures would occur at the secondary dryers and blow-through rates from the secondary dryers to the vacuum would be excessive. Accordingly, I prefer to place secondary dryers on separate pressure control, by inserting a control valve in the supply line from the thermocompressor discharge. A pressure transmitter and pressure controller are provided to control the pressure through the control valve in the conventional manner. Accordingly, the secondary dryers may be maintained at low pressure at all times, but never at more than the main group pressure.

The utilization of secondary dryers to condense bleed steam in a useful manner has even further advantages. Since additional steam is condensed by the addition of secondary dryers, and since the additional steam is supplied by the main valve, it is less likely that the automatic control system will need to waste steam to the condenser in order to maintain drainage control. The demand for steam with the additional dryers tends to remain high enough to cause the pressure controller to signal for more steam and not to check the supply of motive steam to the thermocompressor. Accordingly, the differential controller is free to maintain drainage with the thermocompressor without the need to open a valve to the condenser.

DESCRIPTION OF THE DRAWINGS

FIG. 7 is a schematic diagram similar to FIG. 3, but incorporating the subject matter of the present invention in its preferred form in lieu of the steam routing and control system of the prior art.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Figure 1:
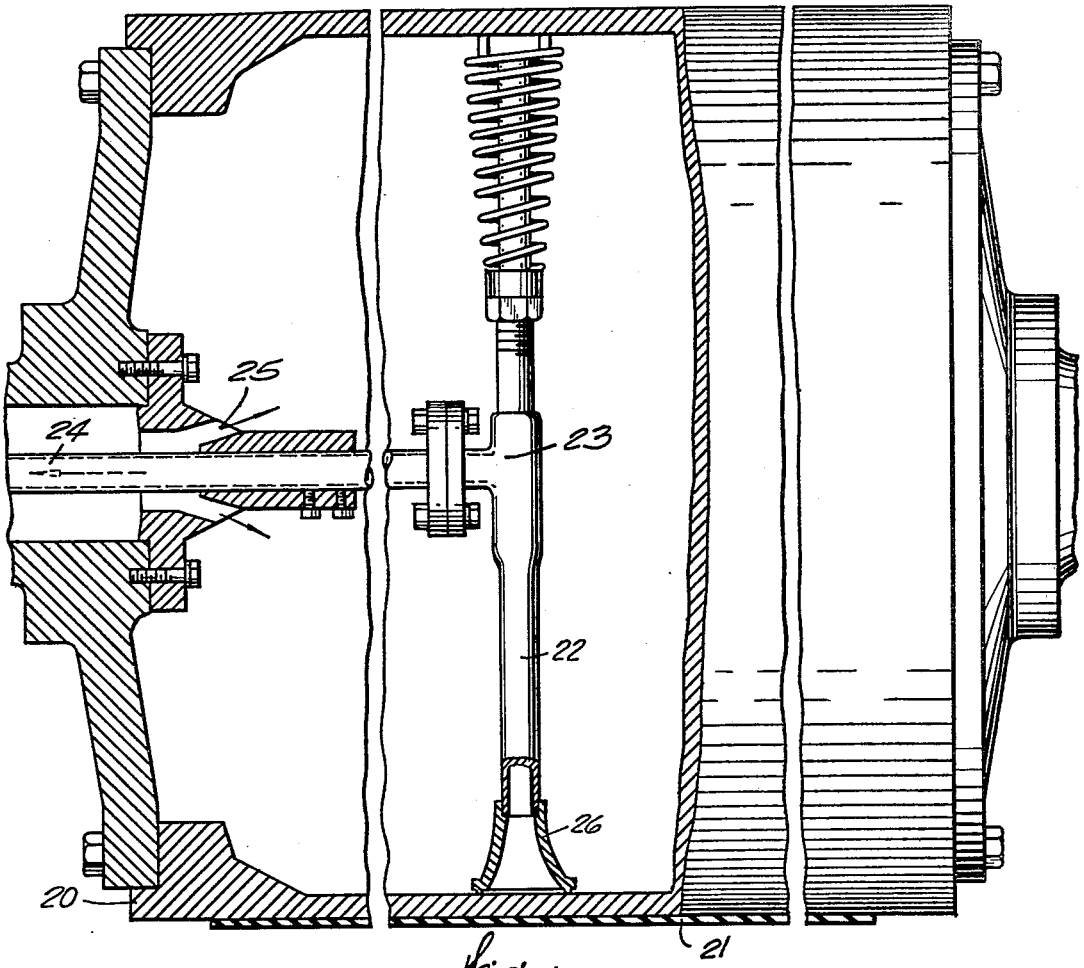
FIG. 1 is a fragmentary cross-section through a drying drum showing details of a conventional rotary syphon pipe therewithin.
Figure 4:
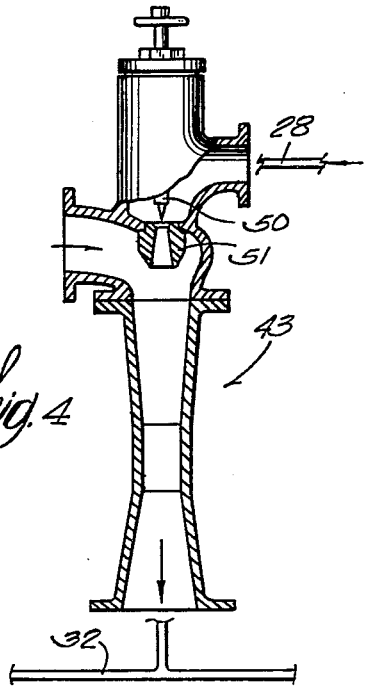
FIG. 4 is a simplified cross-section taken through a thermocompressor of the type utilized in FIG. 3.
Figure 8:
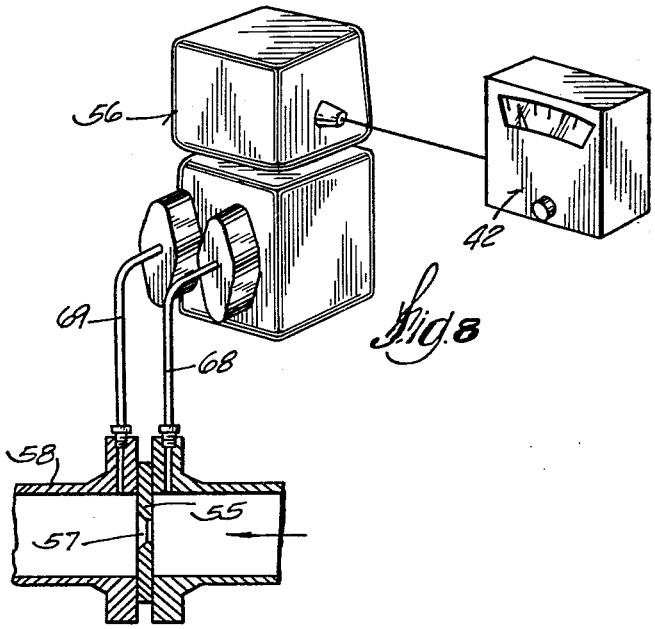
FIG. 8 is a diagrammatic view showing how velocity pressure can be measured in the blow-through steam line.
Figure 2:
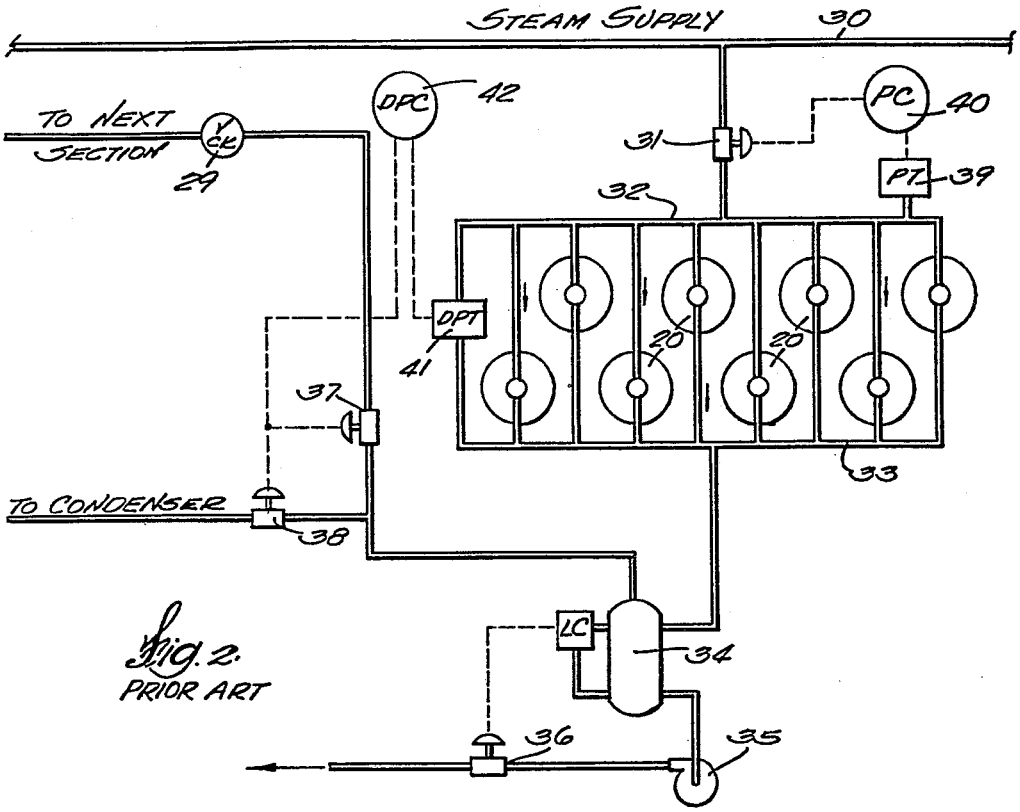
Fig. 2. PRIOR ART
FIG. 2 is a schematic diagram illustrating one stage of a prior art cascade type steam control circuit and dryer drainage system.

The preferred embodiment of the present invention is shown in FIG. 7, with particular parts illustrated in greater detail in FIGS. 1, 4, and 8.

Dryers 20 are arranged in a primary group for drying web 21. Within each dryer (see FIG. 1) is a syphon pipe 22 having a radially extending portion 23 and an axially extending portion 24 for draining the dryer drum 20 and a inlet conduit 25 for admitting live steam into the drum. A shoe 26 at the end of syphon pipe 22 is positioned as close as possible to the wall of dryer for drawing down the water in the dryer to the thinnest possible layer. Most of the steam for drying is derived from a low pressure steam supply 30 connected through control valve 31 to inlet manifold 32 for directing steam through inlet conduits 25 to dryers 20. A drain manifold 33 is provided to collect the blow-through steam, noncondensible gases, and condensate from dryers 20 via outlet conduits 65. Drain manifold 33 is connected by a line 66 to a separating tank 34 where the condensate entrained on the blow-through steam is separated. The condensate is drained by a pump 35, and drainage is regulated by a control valve 36 operated by a level control 67. The material contained in line 58 is thus blow-through steam and noncondensible gases. The blow-through steam then passes through orifice 57 in line 58, where its velocity pressure is measured.

FIG. 8 shows in more detail how velocity pressure is measured. A plate 55 having a orifice 57 is interposed in blow-through steam line 58. Pressure taps 68 and 69 respectively transmit the pressures upstream and downstream of orifice 57 to a differential pressure transmitter 56. In this arrangement the difference in pressure measured at transmitter 56 is proportional to the velocity pressure in line 58.

The blow-through steam line 58 is interrupted by a tap to a control valve 38, which is primarily an emergency dumping valve, not normally necessary to the operation of the system. Steam line 58 is also interrupted by a check valve 70 and terminates at steam jet compressor 43 to recompress the blow-through steam for reuse.

Steam compressor 43 is desirably a thermocompressor which uses high pressure motive steam from steam line 28 to recompress the blow-through steam in line 58. Referring to FIG. 4, the basic construction of a thermocompressor can be seen. Spindle 50 is axially movable in nozzle 51, defining a needle valve to regulate a variable jet of steam fed from line 28 for drawing in and recompressing blow-through steam from line 58. The output of compressor 43 is divided into a first portion for being reintroduced into manifold 32 and a second portion for being introduced via bleed line 71 to secondary dryers 61 via valve 62. Although in this embodiment of the invention the secondary group of dryers is physically distant from the first group, this is not essential, as the secondary dryers could be, and typically would be, physically grouped with the primary dryers. The essential difference between the primary and secondary dryers is that the output of the secondary dryers is not recycled, but rather is transmitted to condenser 72.

Now that the flow of steam has been illustrated, the control means for regulating the flow of steam in various parts of the system can be described.

The steam pressure in inlet manifold 32 is measured by pressure transmitter 39 which transmits a proportional pneumatic pressure signal to pressure controller 40. Controller 40 compares this signal to its set point pressure and transmits a pneumatic control signal to control valve 31 to decrease or increase steam pressure as required. The control signal, initially 3 psi, is steadily increased until valve 31 is sufficiently opened to maintain the set point steam pressure. Valve 31 is typically sized to admit substantially less than the total steam requirement for the system to allow for the additional steam recycled into the system. The control signal put out by pressure controller 40 is normally between 9 and 15 psi, and is transmitted both to inlet valve 31 and selector relay 44.

The velocity pressure of the steam in blow-through line 58 is measured by differential pressure transmitter 56, which transmits a proportional pneumatic pressure signal to pressure controller 42. Controller 42 compares this signal to its set point velocity pressure and transmits a pneumatic control signal, initially of 3 psi, which is steadily increased until the set point velocity pressure results. The signal from controller 42 is normally less than 9 psi, and is transmitted both to dumping valve 38 and to selector relay 44.

Selector relay 44 compares the pneumatic signals from controllers 40 and 42 and sends the lower signal (almost always the signal from differential pressure controller 42) to the spindle of compressor 43; the latter valve begins to open at a signal pressure of 3 psi and is fully open at a signal pressure of 9 psi.

Dumping valve 38 begins to open at a signal pressure of 9 psi and is fully open at a signal pressure of 15 psi.

During normal drying the signal from controller 42 controls the output from compressor 43 to maintain the velocity pressure in the blow-through steam line 58 at a preset value. Although the differential pressure in the dryers is not the controlled parameter, a sufficient differential pressure for draining is maintained by controlling the velocity pressure of blow-through steam.

By controlling the velocity pressure of the blow-through steam instead of the differential pressure in the dryers, the practitioner of the present invention can avoid the usual waste of steam in the event of a web break or other sudden reduction in the condensing rate in the dryers. When the condensing rate is suddenly reduced the velocity pressure of the blow-through steam tends to increase because less condensate than usual is formed in the dryer, so less of the kinetic energy of the steam is spent by moving entrained water out of the dryer. At the same time the pressure input at manifold 32 tends to rise because less steam is condensing in the dryers.

The control system of the present invention responds to these changes by reducing the differential pressure in the dryers while maintaining the velocity pressure of the blow-through steam at or near its preset value. Referring to FIG. 7, when the foregoing changes occur, due to a web break or otherwise, the velocity pressure transmitted to controller 42 will tend to increase above its set point, and in response the signal transmitted from controller 42 to selector relay 44 will be reduced. At the same time the input pressure signal transmitted to pressure controller 40 will tend to rise above its set point, decreasing the signal transmitted to selector relay 44 slightly, but not enough to cause selector relay 44 to transmit the signal from controller 40 to compressor 43. Controller 42 will continue to operate the needle valve within compressor 43 to reduce the flow of high pressure steam, reducing the amount of work done by compressor 43. The reduction of the signal transmitted from pressure controller 40 will also reduce the opening of valve 31, further reducing the flow of steam into manifold 32. In contrast to the prior system, in which the control system tried (usually unsuccessfully) to maintain a constant differential pressure in spite of a reduced condensing load, and as a result dumped large amounts of steam to the condenser, the present system reduces steam use when the condensing load in the dryers is reduced. Although in the present system a dump valve 38 is provided for extreme conditions of excessive velocity pressure, such conditions rarely develop in the usual course of operation of the system due to the manner of regulation just discussed.

A third possible condition of operation is just after a broken web condition has been dealt with and drying is resumed. At such times the increased condensing load will tend to decrease the blow-through velocity pressure; differential pressure control 42 will open compressor 43 up and increase the input pressure until the blow-through velocity pressure set point is again reached, and thereafter normal operation will continue as set forth above.

A final possible condition to consider is one in which, due to irregular control in some respect, dryers 20 are filling with condensate faster than they are being drained, creating a potential drainage failure. The present control and routing system is particularly able to remedy this situation before harm results. When drainage failure is imminent syphons 22 draw nearly all water and very little steam, and more differential pressure is needed to overcome the high centrifugal force tending to oppose drainage. The prior art systems, which kept differential pressure constant, did not respond well to this situation. The dryers tended to continue filling, and drainage failure resulted. The present system does much better. When drainage failure is imminent the water in dryers 20 tends to oppose the flow of steam, tending to decrease the velocity pressure in blow-through line 58. Under that condition controller 42 senses the deficiency and increases the amount of motive steam supplied to jet compressor 43, while pressure controller 40 continues to maintain the pressure in manifold 32. As a result the inlet pressure and blow-through velocity pressure will be maintained at usual values, resulting in a substantial increase in differential pressure in the dryers. Drainage of the dryers is thus increased as necessary to prevent drainage failure.

The routing of steam through the system of FIG. 7 is also very important. In prior systems steam was bled from blow-through line 58 at all times. In the present system all the blow-through steam, including noncondensible gases, is directed through compressor 43, increasing the density and pressure of recycled gases. The bleed steam is taken from the output of compressor 43, essentially at the pressure of manifold 32, and not at the pressure of line 58. The result is a system in which the bleed steam is recompressed to a useful pressure for secondary drying. Since inlet pressure at manifold 32 is also more constant than the pressure in line 58, as the former is directly regulated and the latter only indirectly, the bleed via line 71 can be essentially constant, never rising much above its minimum necessary value.

Pressure controller 64 is optional but is highly desirable to limit the amount of steam bled to the condenser. Pressure transmitter 63 measures the input pressure for the dryers and transmits it to pressure controller 64, which opens valve 62 sufficiently to provide a low pressure (for example, 0 psi gauge pressure) at pressure transmitter 63. The pressure at outlet conduits 74 is much lower than 0 psi gauge pressure, (typically 7 to 10 psi of vacuum), as the flow is directed to a vacuum condenser 72. The amount of bleed steam directed to the condenser is thus regulated, and the heat value of steam passed to the condenser is first reduced by condensation in the secondary dryer drum system.

Figure 5:
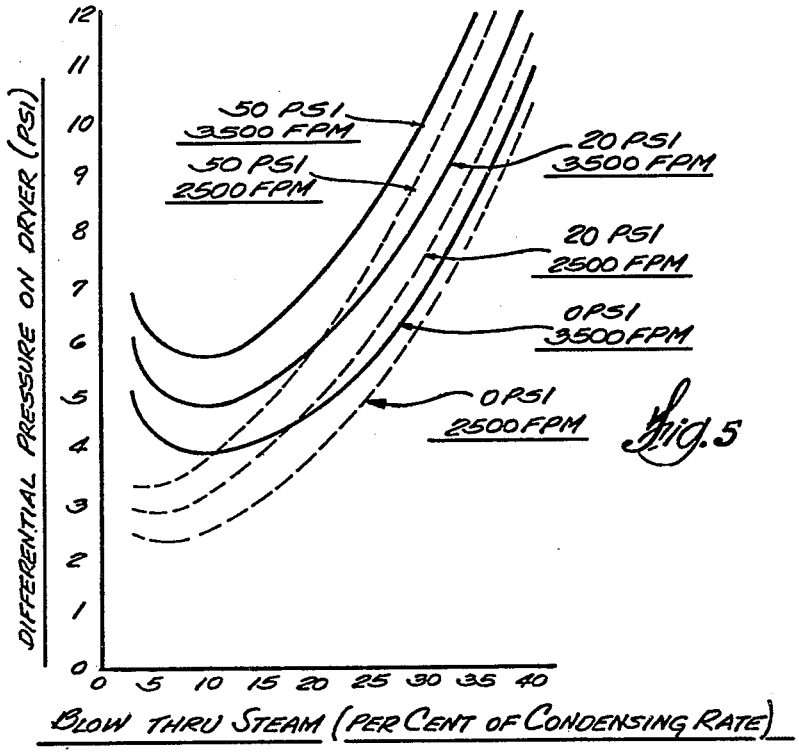
FIG. 5 is a graph showing several plots of differential pressure across the dryer against blow-through steam as a percentage of condensing rate for various operating conditions.

The implications of the constant percentage blow-through provided by my method become apparent with inspection of the drainage performance curves of FIG. 5. In the practice of my method, percentage blow-through might be set at 20%, which would hold nearly constant throughout the range of operating conditions represented. At maximum pressure and speed the differential pressure would be 7.2 psi, and at 0 psi and 2500 fpm the differential pressure would drop to 4.0 psi. The 20% blow-through rate, which is ample to drain the dryers at any time, would remain nearly constant at all times. In contrast, the prior art method of differential pressure control would typically result in about 40% blow-through steam at the fixed differential pressure of 10 psi when operated at 0 psi and 2500 fpm. The difference in blow-through rates and differential pressures between the two methods represents great savings of energy, steam, and control functions. In fact, the prior art method is completely unworkable at a steam input pressure between about 0 psi and 15 psi (gauge).

Figure 3:
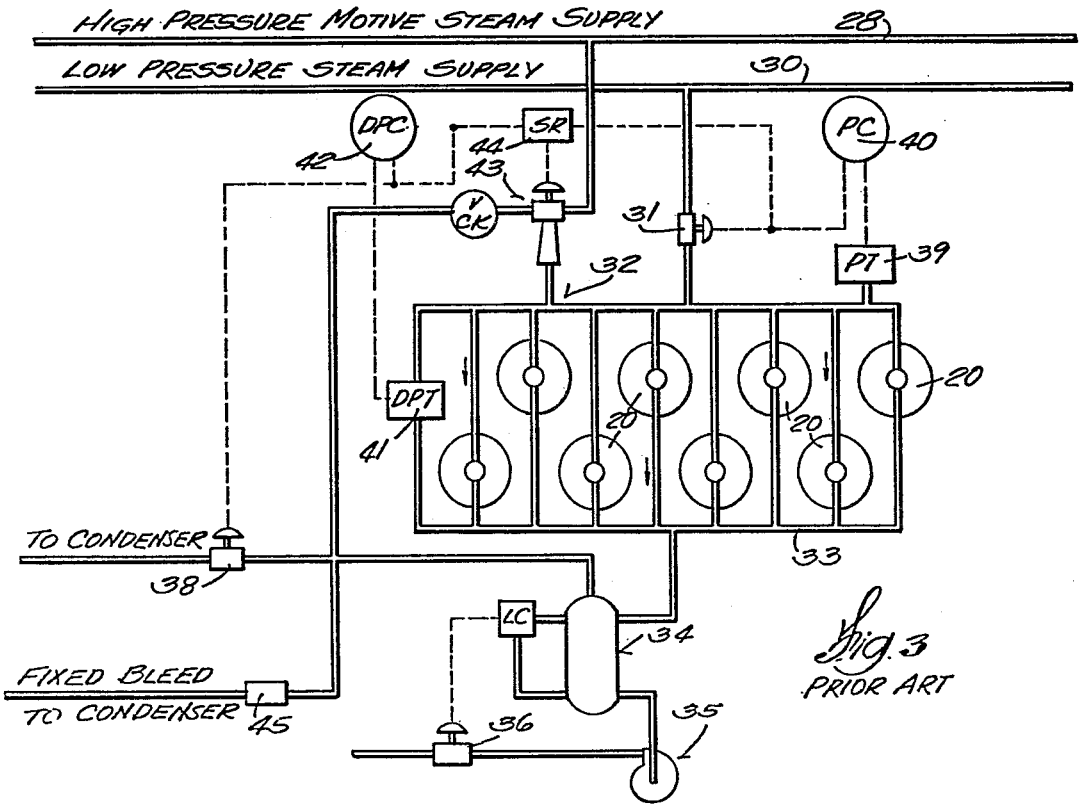
Fig. 3 PRIOR ART
FIG. 3 is a schematic diagram similar to FIG. 2, but illustrating a recirculation type steam control employing a thermocompressor to recompress blow-through steam.

Although the utilization of velocity pressure control of blow-through alone provides substantial improvements in control response, range of pressure control, and energy conservation, it is still inadequate for the needs of drying systems. At 0 psi input pressure in the above example, a differential pressure of 4 psi in the dryers is still required, and a further 2 to 3 psi pressure drop occurs in the piping and apparatus through which the blow-through steam must pass if it is to be recirculated. Accordingly, the bleed steam must flow from a vacuum of 6 to 7 psi to a condenser maintained at even lower pressures. The prior art bleed valve 45 (see FIG. 3) must be quite large to pass sufficient bleed steam at such low pressures with minimal pressure drop, and all of the bleed steam is wasted. At any other pressure, 20 psi for example, the pressure drop imposed on the bleed valve 45 is multiplied many times. At the same time the specific volume of the bleed steam is several times less, and the result is several times greater flow of bleed steam with great waste. Because of this problem, I have found the lowest practical pressure in a recirculation type drainage system under velocity pressure control alone is about 8 psi. When differential pressure is controlled the lowest practical input pressure is about 15 psi.

The present invention requires a combination of velocity pressure control of blow-through steam and the utilization of recompressed blow-through steam in secondary dryers. In the preferred arrangement the secondary dryer inputs are maintained by a pressure control at close to (either above or below) 0 psi; they are supplied with steam from the discharge of the thermocompressors; and they discharge their blow-through steam directly to a vacuum condenser. Because the secondary dryers are few in number, possibly only one dryer, and because they are maintained at low pressure with minimal differential pressure, the waste of steam to the condenser is very small and does not change very much. Even if the primary group of dryers is operated at maximum pressures, there is no related increase in wasted steam. But at the same time, a large amount of bleed steam is usefully consumed by condensation inside the secondary dryers. In the practice of my invention, I have successfully operated the primary group of dryers at pressures of 1 to 2 psi and at other times at pressures over 30 psi without any increase in wasted steam.

Figure 6:
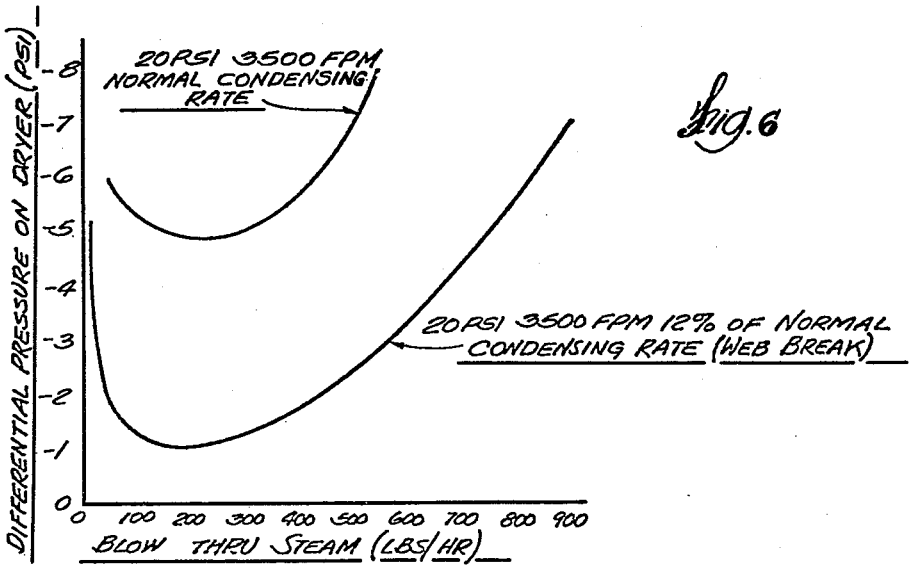
FIG. 6 is a graph plotting differential pressure across the dryer against the flow rate of blow-through steam measured in pounds per hour.
Figure 1:
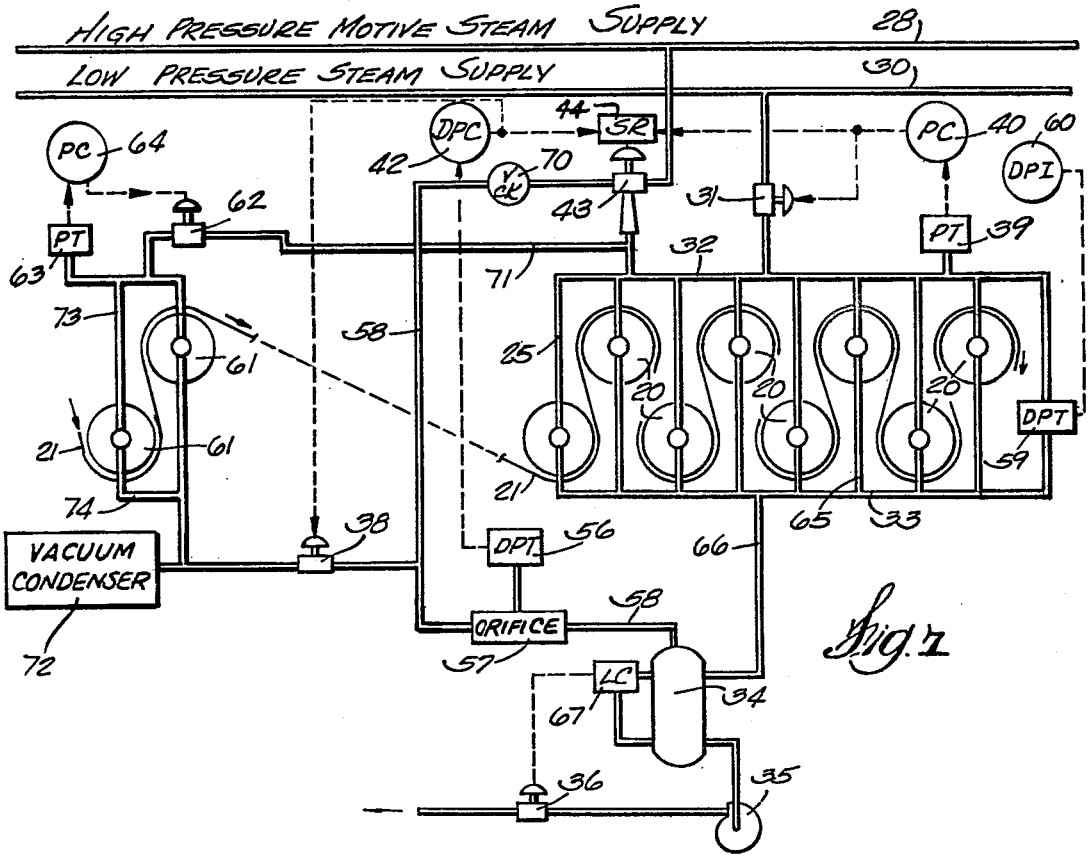

Another advantage of my system is demonstrated upon loss of drying load during a web break. At any fixed condition of operation, as for example 20 psi and 3500 fpm, my system maintains a constant gravimetric rate of flow of blow-through steam, and for practical purposes this remains true even during a web break. With reference to FIG. 6, my method might be maintaining a blow-through rate of 400 lbs./hr. under normal load or condensing rate. Upon loss of load to 12% of normal, the gravimetric blow-through rate would change very little and differential pressure would drop from 6 psi to about 2 psi. Since the dryers are maintained at 20 psi, the initial pressure of the blow-through steam would be about 14 psi, and after load loss it would be about 18 psi. This small change in pressure and density would result in the blow-through rate increasing from 400 to 425 lbs./hr. during a web break. This is a very great improvement over an increase from 580 to 960 lbs./hr. at a differential of 8 psi when using conventional differential control. The latter will almost certainly result in loss of control in addition to great steam waste, whereas my method results in little or no waste.

The automatic response of my system during a web break is critical to its success. Whereas prior art recirculating type systems fail because the thermocompressor is asked to recirculate almost twice as much blow-through steam during a web break, my invention actually reduces the work of the thermocompressor. Although the amount of blow-through steam may increase slightly, the reduction in differential pressure results in a substantial reduction in the amount of compression work and in the amount of motive steam needed to accomplish that work. As a result my system rarely wastes steam to the condenser during a web break.

My invention also demonstrates rapid and effective response to load changes. On occasion operators or automatic controllers may suddenly raise the steam pressure in the primary group of dryers. The dryers incorporate great masses of iron with high thermal inertia, and a sudden increase in steam pressure causes condensing rates far in excess of normal for a short period. The prior art differential control is little affected by an occurrence of heavy condensing, and if the machine is running at high speed with marginal differential pressures, drainage may stop and the dryers commence to flood with condensate. My velocity pressure control works to maintain the velocity of the blow-through steam even if the dryer syphons are periodically loaded with heavy surges of condensate. In this event my controls immediately react to increase motive steam to the thermocompressor and to open the differential valve 38 to the condenser if necessary. In effect my method causes an immediate and sharp increase in differential pressure to overcome the emergency of a sudden surge in condensing rate.

I claim:

1. In a steam dryer system for drying a moving web including a primary group of rotatable drying drums in contact with the web; primary steam inlet conduits for supplying steam at a first pressure to said primary drums; primary steam outlet conduits for exhausting blow-through steam, condensate, and noncondensible gases therefrom at a second pressure lower than the first pressure, the noncondensible gases being transported by the blow-through steam; and means for separating said condensate and said blow-through steam, an improvement for directing substantially all of said blow-through steam and noncondensible gases at the first pressure for further drying the web comprising:

a secondary group of rotatable drying drums in contact with the web and having secondary steam inlet conduits and secondary steam outlet conduits for exhausing blow-through steam condensate, and noncondensible gases at a substantial negative pressure, a thermocompressor for recompressing the blow-through steam and noncondensible gases to the first pressure; conduit means for directing the blow-through steam from the separating means to the thermocompressor; velocity pressure control means communicating with the conduit means and the steam jet compressor for maintaining a constant velocity pressure at the primary steam outlet conduits; and flow dividing means for dividing the output from said compressor into a first stream re-entering said primary inlet conduits and a second stream supplying the secondary steam inlet conduits for the secondary group of drying drums so that the primary group of dryers may be operated at low pressure, and so that a selected ratio of blow-through steam to normal rate of condensation in the primary dryers is maintained at a sufficiently low pressure to provide stable control and without wasting steam by bleeding at any operable pressure.

2. The steam dryer system of claim 1, further comprising means for indicating the differential pressure between the primary steam inlet conduits and the primary steam outlet conduits, the differential pressure indicating means being used as a set point reference for the velocity pressure control means.

3. The steam dryer system of claim 1 wherein the selected ratio is from about 0.15 to about 0.40.

4. The steam dryer of claim 1, further comprising pressure control means between said compressor and said secondary steam inlet conduits for maintaining the steam pressure applied to said secondary dryers.

5. The steam dryer of claim 4, wherein the steam pressure applied to said secondary dryers is maintained at a gauge pressure of approximately −3 to 10 pounds per square inch.

6. The steam dryer of claim 4 wherein said steam pressure applied to said secondary dryers is maintained at about the same pressure as the first pressure of the steam to the primary drums.

7. The steam dryer of claim 1, wherein the steam inlet conduits are maintained at a gauge pressure of approximately 0 pounds per square inch.

8. In a method for drying a web moving over at least two groups of rotatable drying drums in contact with the web including the steps of supplying steam at a first pressure to a primary group of drying drums; exhausting blow-through steam condensate, and noncompressible gases from the primary drums at a second pressure lower than the first pressure; and separating the condensate from the blow-through steam and non-compressible gases, the improvement for recycling substantially all the blow-through steam from the primary drums for further drying the web, comprising the steps of:

providing a second group of drying drums; measuring the velocity pressure of the exhausted blow-through steam from the primary drums to obtain a velocity pressure signal; re-compressing the blow-through steam from the second pressure to the first pressure under the control of the velocity pressure signal to maintain a constant velocity pressure of the primary exhausted blow-through steam; dividing the recompressed blow-through steam into two paths, the first path re-supplying the primary group of drums and the second path supplying the secondary group of drums; and exhausting blow-through steam, condensate, and noncondensible gases from the secondary drums at a substantial negative pressure, so that the primary group of dryers may be operated at low pressure, and so that a selected ratio of blow-through steam to normal rate of condensation in the primary dryers is maintained at a sufficiently low pressure to provide stable control and without wasting steam by bleeding at any operable pressure.

9. A steam dryer system for drying a moving web, including a primary group of rotatable drying drums in contact with the web; primary steam inlet conduits for supplying steam at a first pressure to said primary drums; primary steam outlet conduits for exhausting blow-through steam, condensate, and noncondensible gases therefrom at a second pressure lower than the first pressure, the noncondensible gases being transported by the blow-through steam; means for separating said condensate and said blow-through steam; means for measuring and controlling the velocity pressure of the blow-through steam flowing in a conduit from the separating means to a thermocompressor; a thermocompressor for recompressing the blow-through steam to the first pressure; flow dividing means for dividing the output from said compressor into a first stream supplying the primary steam inlet conduits and a second stream supplying secondary steam inlet conduits for secondary dryers, including a secondary group of rotatable drying drums in contact with the web, and having secondary steam inlet conduits, and secondary outlet conduits for exhausting blow-through steam, condensate, and noncondensible gases to a conduit having substantial negative pressure, so that the primary group of dryers may be operated at low pressure and so that a selected ratio of blow-through steam to normal rate of condensation in the primary drying drums is maintained without wasting steam by bleeding at any operable pressure.

* * * * *